United States Patent [19]

Sanmartin Rial

[11] 4,134,164

[45] Jan. 16, 1979

[54] WATER STANDPIPE FOR TOILET SUMP TANKS

[76] Inventor: José S. Sanmartín Rial, San Ruperto a Soledad No. 2-1, La Pastora Caracas, Venezuela

[21] Appl. No.: 843,036

[22] Filed: Oct. 17, 1977

[30] Foreign Application Priority Data

Oct. 23, 1976 [ES] Spain ..... 452.665

[51] Int. Cl.[2] ..... E03D 1/30

[52] U.S. Cl. ..... 4/353; 137/436

[58] Field of Search ..... 4/353, 366; 137/436, 137/434, 386, 409; 251/118

[56] References Cited

U.S. PATENT DOCUMENTS

| | | | |
|---|---|---|---|
| 2,766,769 | 10/1956 | Carnahan | 137/436 |
| 3,516,094 | 6/1970 | Reagan | 137/436 |
| 3,785,397 | 1/1974 | Young | 137/436 |
| 3,853,141 | 12/1974 | Fischer | 137/436 |

*Primary Examiner*—Richard E. Aegerter
*Assistant Examiner*—L. Footland
*Attorney, Agent, or Firm*—Lewis H. Eslinger

[57] ABSTRACT

This invention relates to a novel and original water standpipe for toilet sump tanks, including multiple discharger-silence device water standpipe of sufficiently novel characteristics to distinguish it from the prior art.

7 Claims, 12 Drawing Figures

Fig. 2
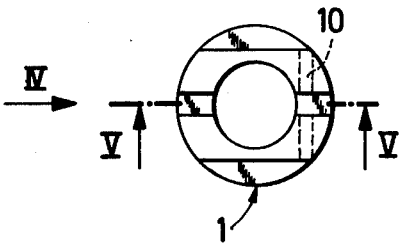
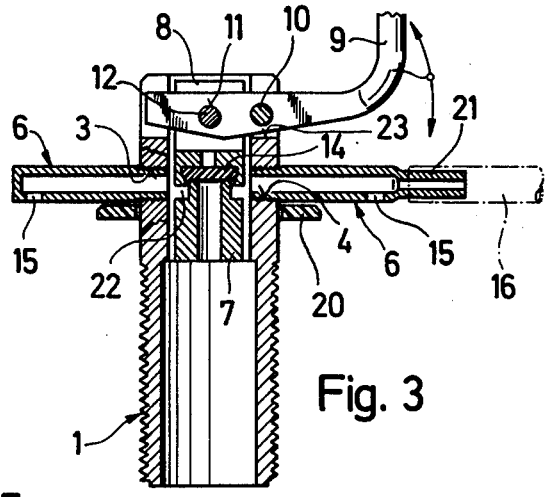
Fig. 3
Fig. 4
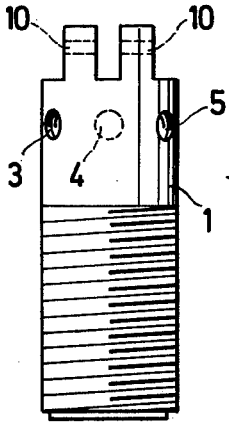
Fig. 5
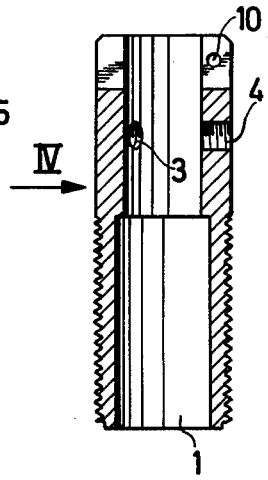
Fig. 6A
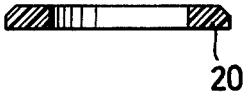
Fig. 6B
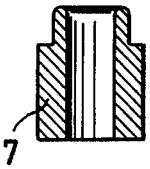
Fig. 6C
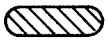
Fig. 6E
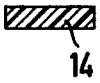
Fig. 6D
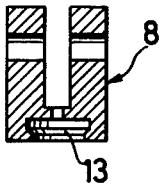
Fig. 7
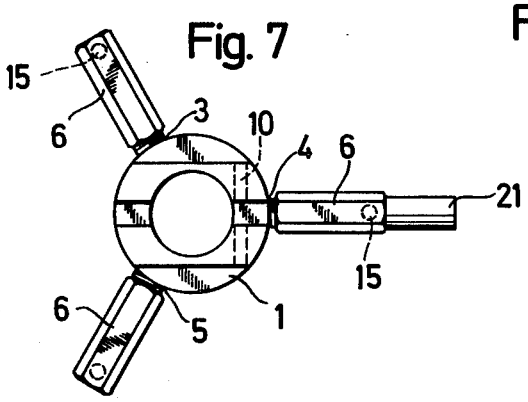
Fig. 8
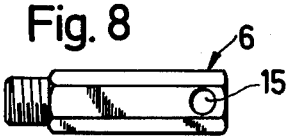

WATER STANDPIPE FOR TOILET SUMP TANKS

BACKGROUND OF THE INVENTION

Known standpipes for sump tanks have a series of disadvantages which accentuate the need for an improved standpipe which can provide better service, is more durable and can be manufactured at lower cost.

For example, among the disadvantages of known standpipes are the following:

(1) Bothersome noises when water circulates through the standpipe, even more evident in systems employing hydropneumatic pressures.

(2) Between the surfaces of the inner walls of the valve or standpipe cylinder and outer wall of the plunger there is necessarily a free space through which water passes upward when the standpipe is in open position, resulting in the spattering of this water against the tank lid and its subsequent spillage to the exterior, with the consequential nuisance of a wet floor in the lavatory or restroom where the standpipe is installed. With the passage of time this free space becomes larger owing to normal wear of the parts, and the spillage logically increases.

(3) Some known standpipes employ devices known as stoppers to avoid the problem of (2) above, but while these stoppers prevent water spillage outside the tank, they hinder the proper function of the apparatus.

(4) Inasmuch as all the standpipes thus far known have to be placed above the level of water in the tank, their cost of manufacture is higher because longer support and waste-discharge pieces are required.

A novel and original standpipe for toilet sump tanks has now been created and is the basis of the present invention; it has the following advantages, among others:

The standpipe has very few parts and its construction is extremely simple, wear of the parts thus being minimal.

Its complete connection by means of shafts and bearings and the absence of special rubber gaskets and anti-spatter stoppers permits the force produced by the float to be employed to the maximum, so that even at the highest water pressures (for example, in hydropneumatic systems) operation is efficient and silent, providing rapid cutoff of the water flow and long duration.

In the manufacture of the standpipe, owing to its peculiar design, there is absolutely no casting of the component parts, but rather automatic machine-tools are used to make the principal parts by machining solid or drilled metal bars.

Its size, reduced to the minimum, permits manufacture at an economic price, even when employing materials of the best quality for longer duration and efficient operation.

The standpoint of this invention is designed to operate beneath water level, which means lower manufacturing cost and more efficient operation, providing a service completely free of spattering inasmuch as the standpipe is entirely and permanently submerged.

The float rod is of a new design and can also be adjusted in a horizontal direction; there are no interposing parts between the rod and the standpipe and it is impossible to impede perfect function of the waste discharge valve.

In addition, the standpipe of this invention is provided with multiple discharger-silencer devices which permit optimum performance and at the same time maximum silence by greatly reducing bothersome noises.

For a better understanding of this invention reference is made to the accompanying drawings, which form an integral part of this description and will compensate for any possible omission herein.

FIG. 2 is a plan view of the body of the standpipe of FIG. 1.

FIG. 3 is a cut-away cross-sectional view illustrating the component parts of the standpipe of FIG. 1.

FIG. 4 is a side view of the body of the standpipe of FIG. 3.

FIG. 5 is a cross-sectional view of the body of the standpipe of FIG. 4.

FIGS. 6A, 6B, 6C, 6D and 6E are cross-sectional views of the various component parts of the standpipe of this invention.

FIG. 7 is a plan view of the body of the standpipe of FIG. 1, onto which the multiple discharger-silencer devices have been screwed.

FIG. 8 illustrates one of the discharger-silencer devices of the standpipe of this invention.

Figure 1:
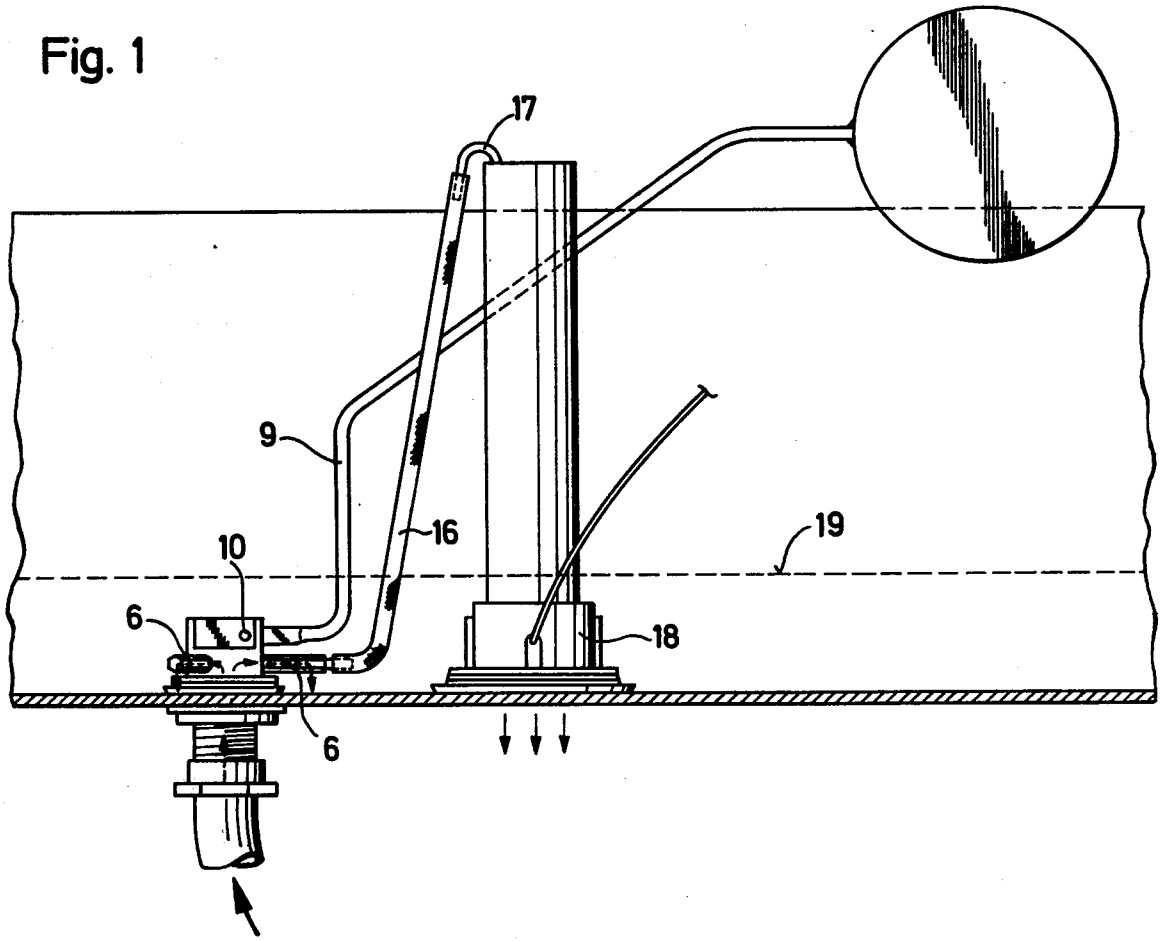
FIG. 1 is a partially cut-away side view of a flush-toilet sump tank in which a standpipe according to this invention has been installed.

As may be seen from the drawings, the improved standpipe of this invention is comprised of a hollow cylindrical body 1 of an internal diameter of approximately 11 mm in its upper portion over a length of approximately 29 mm; the internal diameter of the lower portion is approximately 17.5 mm over a length of 26 mm. In the center of its portion of reduced internal diameter the body of the standpipe has three identical ¼ × 40 horizontal perforations 3, 4 and 5 arranged at 120° from one another, into each of which is screwed a discharger-silencer device 6 through which the water inside the sump tank is discharged, as will be detailed farther on.

Externally, the body of the standpipe 1 has a diameter of 23.8 mm and a total length of 65 mm. The external portion of the body 1 is provided, in approximately the lower half of its length, with multiple threads comprising a screw element for receiving all the nuts for fastening the standpipe to the bottom of the tank and for coupling the outside water pipe.

Located inside the reduced-diameter portion of the body 1 is the hollow cylindrical valve member 7 of an external diameter of 11.10 mm. Said valve 7 is pressure-fitted to remain firmly fastened in said portion of reduced diameter, which portion has an internal diameter of approximately 11 mm, or slightly less than the external diameter of valve 7. The upper part or nozzle of valve 7 has an external diameter of 7.5 mm, thus leaving an empty space between its external surface and the internal surface of the wall of body 1, thereby creating a chamber for the water.

Coincident and corresponding to valve 7, the H-shaped closure element or plunger 8 of an external diameter of 10.95 mm is movably fitted in the upper part of the portion of reduced diameter. Said plunger 8 is activated to close valve 7 by the force supplied by a conventional float through a rod 9 swivel-fastened at point 10 by means of a bolt or pin (of conventional type and not illustrated in the drawings), and to open said valve the plunger 8 is raised, as the water level lowers, by the movement of the rod 9 and the movement of the float itself. The travel of rod 9 is limited by a stop at point 23 which prevents it from lowering too far. Said rod 9, operationally joined to the plunger 8 at point 11 by means of a bolt 12, is not straight but first rises vertically and then breaks to the right at an angle of approximately 30°, then breaks again to the right to become horizontal once more, finally joining with the float. The bolt 12 serves as axle for the coupling of said end of the rod 9 with the plunger 8.

The lower portion of the plunger 8 contains an inward conical or tapered depression 13 forming a cavity for holding a sealing element 14. The greatest diameter of said conical cavity 13 is approximately 9.5 mm and its smallest diameter is 9 mm, the external diameter of the sealing element 14 being 9.5 mm. Thus with said sealing element seated in the depression 13 it is held fast there by simple pressure, without need of any type of adhesive or fastener.

As has been stated, the body of the standpipe 1 has three perforations 3, 4 and 5, into each of which is screwed a respective discharger-silencer device 6 of hexagonal external shape, each of said devices being threaded on one end to thus be received in one of said perforations 3, 4 and 5. The other end of two of the discharger-silencer devices is closed off, while the same end of the third bears a tubular extension 21 to permit the fitting thereto of a hose 16 designed to carry water to the downpipe from the bowl of the sump. The discharge end of all three discharger-silencer devices 6 contains, placed perpendicular to the horizontal and coinciding with one of its flat sides, a discharge hole 15 constituting the element of direct discharge of the fluid inside the water tank of the toilet where the novel standpipe of this invention is installed, of the fluid proceeding from the toilet when the plunger 8 is moved upward by the compound weight of rod 9 and the float (illustrated in only diagram form). The discharger-silencer devices have a length of 21 mm, plus 5 additional mm on their threaded end. The internal diameter of said discharger-silencers is 3.6 mm, or the same as the diameter of the discharge hole 15. The internal diameter of the tubular extension 21 is 2 mm. Increasing or reducing this diameter will increase or reduce the amount of water sent to the sump. If necessary, to achieve even more silent operation the said discharger-silencers can be made longer, but conserving the given diameters.

The discharger-silencers are screwed into perforations 3, 4 and 5 in such manner that the holes 15 are always aimed downward for better service in discharge of the water. This also enables the three flat sides of the hexagons of all the discharger-silencers to serve as rests for the assembly on the washer 20, thus supporting said valve body 1 in relation to the tank bottom. Simultaneously the washer 20, firmly held by the pressure of the nut outside the tank against the lower sides of the hexagons of the three discharger-silencers, insures that these do not unscrew and guarantees water entry always toward the bottom of the tank. Said washer has an internal diameter of 24 mm, and use is also made of the conventional means of a rubber cone and an exterior nut screwed to that part of the body 1 which remains outside the tank to receive the adduction of water coming from the toilet.

As has been stated, the hose 16 is connected to extension 21 and at its other end to a pipe of copper, brass or any other suitable material to form an elbow 17, the external diameter of said pipe being slightly greater than the internal diameter of hose 16, so that they couple with merely the sufficient pressure to keep them joined, the pipe 17 being inserted in the hose 16. Said hose and pipe are held taut when said elbow pipe is hooked to the edge of the downpipe of the discharge valve. In this manner there is a continuous supply of water, during the filling of the tank, to the bowl of the toilet, as has already been established.

It is evident that in the bowl of certain toilet sumps this supply of water through the downpipe of the discharge valve for the toilet bowl is unnecessary, since provision is made for permanent water in the bowl due to its special design and that of its trap, and thus the hose 16 does not have to be placed over the edge of the discharge valve, and can simply be eliminated or left free inside the water tank, resulting in an increase in the flow of water entering at any moment when the plunger 8 is in open position.

When a standpipe such as has been described in this specification is used in a toilet water tank the water enters through valve 7 and its chamber 22, passing consecutively through apertures 3, 4 and 5 and the discharger-silencers and their holes 15, filling the tank and simultaneously serving a substantial quantity of water to keep the toilet bowl at a predetermined level. Once the toilet has been used and the water proceeds to empty from the tank in order to remove the waste through the discharge valve 18, when the water in the tank drops to the level indicated by the broken line 19 the lid of said valve 18 closes, the quantity of water remaining in the tank reaching approximately said level 19. At this moment the float, which has been dropping together with the water level, opens or raises the plunger 8, thus permitting water to pass through valve 7 and its chamber 22 to fill the tank by means of the perforations 3, 4 and 5 and the holes 15 in the discharger-silencer devices. Simultaneously, water passes through the tubular extension 21 and hose 16 and through the elbow pipe 17 in order to fill the bowl of the sump, as was indicated earlier.

At the moment valve 8 permits the water to pass from the water service pipe to the interior of the tank this is done horizontally, as may be seen from the drawings, but logically and due to pressure, a limited quantity of water passes through the clearances existing between the inner walls of the valve body 1 and outer wall of the plunger 8 and tends to flow upward. If this vertical stream could flow freely it would spatter the lid of the tank and subsequently spill outside with the bothersome consequences as already mentioned, but as the standpipe of this invention is designed for use below the level of the water remaining in the bottom of the water tank after the water is discharged to remove the waste, this water level offers sufficient resistance to prevent said flow from continuing upward and diverts it toward the sides, thus eliminating the need to employ other devices in the standpipe which would require more difficult and costly construction, and would result in less efficiency and a shorter life. Even though due to natural wear the mentioned clearances become larger, thus increasing the flow of water escaping upward, this is always controlled and its rising path obstructed by the mass of water existing over said standpipe.

The particular design of the standpipe for toilet tanks with which this invention is concerned permits it to be constructed by means of automatic machine-tools from solid or drilled metal bars, casting of the component parts being unnecessary, with the result that production costs are greatly reduced and at the same time the final product is better finished and of higher quality.

It is also evident that the standpipe of this invention can be used for purposes other than that explained in the water tank of a flush toilet. For example, it can be used in a water tank such as those employed for general service in homes. In general, it can be used to control the supply of any type of fluid inside a certain tank, providing the same advantages as already explained.

Also, the copper pipe forming the elbow 17 can be made so that its end connected to the hose 16 is prolonged inside said hose 16 to thus permit adjustment of the tension of said hose in those toilets where the height of the downpipe of the discharge valve varies.

What is claimed:

1. Improvements in or relating to a water standpipe for toilet sump tanks, comprising in combination a hollow cylindrical standpipe body of smaller internal diameter in the upper third of its length and containing three horizontal perforations at an angle of 120° from one another to permit the exit of water to the service tank through respective discharger-silencer devices of hexagonal exterior shape; a H-shaped plunger containing a cavity in its lower portion for receiving a seal of rubber or any other appropriate material which remains firm in said cavity because of the latter's inverted frusto-conical shape; a hollow valve to permit the passage of water, the nozzle of which valve has a diameter slightly less than that of the rest of its circumference, so that a chamber is formed between said nozzle and the inner surface of the body of the standpipe; and a rod operationally connected to said plunger by a bolt, said rod being pivotally joined to the body of the standpipe by means of a conventional bolt.

2. Improvements as claimed in claim 1, according to which the standpipe also has a hose coupled at its distal end to a tubular extension fitted to one of the three discharger-silencer devices, the other end of said hose containing an exit valve in the form of an elbow to supply water to the downpipe of the toilet discharge valve.

3. Improvements as claimed in claim 1, according to which the standpipe also comprises a washer in surface contact with said standpipe body which rests upon said washer by means of one of the flat sides of each of the hexagonal discharger-silencer devices, said washer also serving to seat said body on the floor of said tank, the said lower portion of said standpipe body being filleted for fastening in a conventional manner to the bottom of said tank.

4. Improvements as claimed in claim 2, wherein said hose is pressure-fitted to said elbow to remain firmly fastened thereto.

5. Improvements as claimed in claim 1, according to which said rod follows the course of a bent line, being vertical in its first length, oblique in its middle portion and horizontal in its final portion, said final portion being joined to a conventional float means with which it acts in unison.

6. Improvements as claimed in claim 1, according to which the said discharger-silencer devices, as previously established, have a hexagonal exterior shape, their proximal end being threaded for coupling to the body of the standpipe and their distal end being closed off, a discharge aperture being located perpendicular to the horizontal and close to this distal end.

7. Improvements as claimed in claim 6, according to which the distal end of one of said discharger-silencer devices contains a tubular extension of smaller external diameter than the rest of the device for receiving a hose through which water passes to the downpipe of the toilet.

* * * * *